US009528425B2

(12) United States Patent
Lee et al.

(10) Patent No.: US 9,528,425 B2
(45) Date of Patent: Dec. 27, 2016

(54) EXHAUST SYSTEM STRUCTURE FOR IMPROVING NOISE PROBLEM

(71) Applicants: HYUNDAI MOTOR COMPANY, Seoul (KR); KIA MOTORS CORPORATION, Seoul (KR)

(72) Inventors: Jong Kyu Lee, Bucheon-si (KR); Jeong Il Lee, Seongnam-si (KR); Dong Jun Yu, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 14/750,653

(22) Filed: Jun. 25, 2015

(65) Prior Publication Data

US 2016/0146086 A1 May 26, 2016

(30) Foreign Application Priority Data

Nov. 26, 2014 (KR) ..... 10-2014-0166792

(51) Int. Cl.
*F01N 3/00* (2006.01)
*F01N 13/18* (2010.01)
*F01N 13/10* (2010.01)

(52) U.S. Cl.
CPC ..... *F01N 13/1805* (2013.01); *F01N 13/107* (2013.01); *F01N 13/1816* (2013.01); *F01N 2470/20* (2013.01)

(58) Field of Classification Search
USPC ..... 60/272, 302, 305, 312, 313, 314, 322,60/323, 324
See application file for complete search history.

(56) References Cited

U.S. PATENT DOCUMENTS 4,046,219 A 9/1977 Shaikh
4,621,494 A * 11/1986 Fujita ..... F01N 13/08 181/240
6,840,039 B2 * 1/2005 Huh ..... B01F 3/02 60/323
7,458,210 B2 * 12/2008 Kikuchi ..... F01N 13/08 60/313
7,520,127 B2 * 4/2009 Ashida ..... F01N 3/28 60/305
8,474,252 B2 * 7/2013 Butler ..... F01N 13/08 60/305

(Continued)

FOREIGN PATENT DOCUMENTS

JP 2007-009836 A 1/2007
KR 10-1998-0076148 A 11/1998

(Continued)

*Primary Examiner* — Binh Q Tran

(74) *Attorney, Agent, or Firm* — McDermott Will & Emery LLP

(57) ABSTRACT

An exhaust system structure includes an exhaust manifold discharging exhaust gas through at least one runner towards an exhaust pipe. A front pipe is connected to a front end of the exhaust pipe. A collector connects the at least one runner and the front pipe. The collector comprises at least one inlet communicating with an exit of the at least one runner. An outlet communicates with the front pipe such that the outlet discharges the exhaust gas into the front pipe through the at least one inlet. An extended portion has a radius greater than or equal to that of the exit of the at least one runner.

11 Claims, 5 Drawing Sheets

(56) References Cited

U.S. PATENT DOCUMENTS

| | | | | |
|---|---|---|---|---|
| 8,601,802 | B2 * | 12/2013 | Yamada | B01D 53/9468 422/169 |
| 8,671,670 | B2 * | 3/2014 | Yamagata | F02D 9/04 60/323 |
| 9,255,503 | B2 * | 2/2016 | Matsumoto | F01N 5/00 |

FOREIGN PATENT DOCUMENTS

| | | | |
|---|---|---|---|
| KR | 10-0394705 | B1 | 8/2003 |
| KR | 10-2009-0079647 | A | 7/2009 |

* cited by examiner

- Prior Art -

- Prior Art -

EXHAUST SYSTEM STRUCTURE FOR IMPROVING NOISE PROBLEM

CROSS-REFERENCE TO RELATED APPLICATION

The present application claims the benefit of priority to Korean Patent Application Number 10-2014-0166792 filed on Nov. 26, 2014, the entire content of which application is incorporated herein for all purposes by this reference.

TECHNICAL FIELD

The present disclosure relates to an exhaust system structure. More particularly, the present disclosure relates to an exhaust system structure capable of improving noise problems.

BACKGROUND

In general, a vehicle generates noise due to engine explosion, intake operation, exhaust operation, friction with air while driving, road, etc.

The exhaust noise includes pulsation noise, flow noise, etc. which are generated mainly due to pressure differences. An exhaust system is in general provided with a muffler to reduce such exhaust noise. However, it is more effective to damp the flow noise of the exhaust system near an engine side, e.g., an exhaust manifold, than in the muffler.

FIGS. 1(A) and 1(B) show exhaust system structures according to a prior art and an exemplary embodiment of the present inventive concept, respectively.

FIG. 1(A) shows an exhaust manifold 10 of an exhaust system according to the prior art.

Exhaust noise, which is caused due to explosion strokes while driving, is collected to a collector 30 through runners 15 of the exhaust manifold 10 and passes through a front pipe 20 to be transferred towards a muffler (not shown).

In this case, a shrink-type collector 30, which has radii decreasing in a direction towards noise transfer, is used in order to naturally connect the runners 15 and the front pipe 20.

Each runner 15 is provided to improve performance of an engine. However, considerably large noise is caused in the collector 30, into which the noises are collected by high-speed exhaust gas, by an increase of jet velocity and generation of vortex. Here, a noise level inside the front pipe 20 as in volume acoustic power (VAP), which is turbulent noise energy per unit volume, reaches 143 dB which is considerably high.

The noise is recognized as rough noise in a gradual acceleration condition of 1500-3000 rpm, thereby causing drivers' dissatisfaction.

Therefore, modification of an exhaust system structure to overcome this kind of problem is necessary. Turbulent flow noise is inevitably generated in the exhaust system according to the prior art, thereby deteriorating marketability of a vehicle.

The above information disclosed in this Background section is only for enhancement of understanding of the background of the disclosure, and therefore, it may contain information that does not form the prior art that is already known in this country to a person of ordinary skill in the art.

SUMMARY

An aspect of the present inventive concept provides an exhaust system structure for improving noise problems.

According to an exemplary embodiment of the present inventive concept, an exhaust system structure includes an exhuast manifold discharging exhaust gas through at least one runner towards an exhaust pipe. A front pipe is connected to a front end portion of the exhaust pipe. A collector connects the at least one runner and the front pipe. The collector comprises at least one inlet communicating an exit of the at least one runner. An outlet communicates with the front pipe such that the outlet discharges the exhaust gas into the front pipe through the at least one inlet. An extended portion has a radius greater than or equal to to that of the one exit of the at least one runner.

The collector may further comprise a nozzle portion having a radius at one end thereof towards the at least one inlet greater than that of another end thereof towards the outlet.

The nozzle portion may include a diminishing portion having a radius which decreases from the one end of the nozzle portion towards the other end of the nozzle portion.

The extended portion has an exit connected to an entry of the nozzle portion. A distance between an outermost end point of the exit of the at least one runner and a maximum radius point of the extended portion in the radial direction of the collector may be less than or equal to half of a distance between the outermost end point of the exit of the at least one runner and an outermost end point of the front pipe in a radial direction of the collector.

An entry of the extended portion may be connected to the at least one inlet.

An exit of the nozzle portion may be connected to the outlet.

A length of the extended portion may be greater than or equal to half of a length of the collector.

A side profile of the extended portion may have a convex or parabolic shape along a length direction of the extended portion.

DETAILED DESCRIPTION

Reference will now be made in detail to an embodiment of the present inventive concept, examples of which are illustrated in the accompanying drawings and described below. While the disclosure will be described in conjunction with an exemplary embodiment, it will be understood that present description is not intended to limit the invention(s) to the exemplary embodiment. On the contrary, the disclosure is intended to cover not only the exemplary embodiment, but also various alternatives, modifications, equivalents, and other embodiments, which may be included within the spirit and scope of the invention as defined by the appended claims.

In addition, unless explicitly described to the contrary, the word "comprise" and variations such as "comprises" or "comprising" will be understood to imply the inclusion of stated elements but not the exclusion of any other elements and the name of a component doesn't set limits to the function of the component concerned.

Figure 1A:
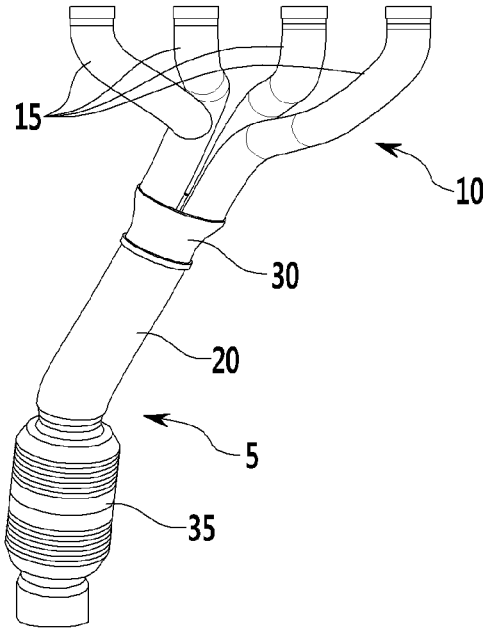
FIGS. 1(A) and 1(B) are drawings for comparing exhaust system structures according to a prior art and the present disclosure, respectively.
Figure 1B:
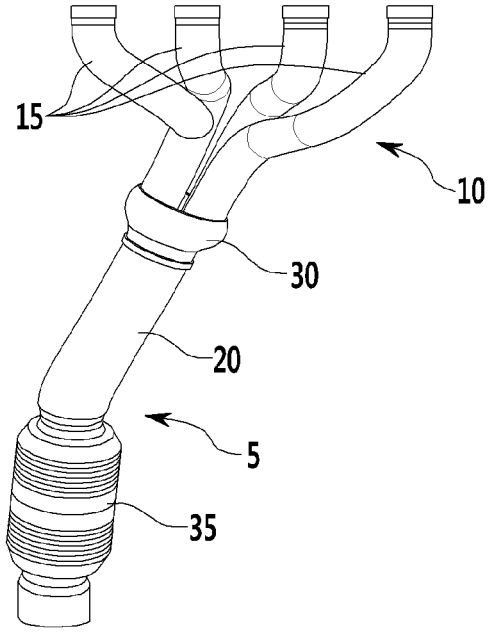

FIGS. 1(A) and 1(B) are drawings for comparing exhaust system structures according to a prior art and the present disclosure, respectively.

Referring to FIG. 1(B), an exhaust system structure according to the present disclosure may comprise at least one runner 15 which is a flow passage of an exhaust manifold 10 to discharge exhaust gas towards an exhaust pipe 5. A front pipe 20 forms a front end portion of the exhaust pipe 5, and a collector 30 connects the at least one runner 15 with the front pipe 20. The exhaust system may further include a bellows 35, which has a cylindrical shape and wrinkles, connected to the front pipe 20.

The bellows 35 is already known to a person skilled in the art, and thus, detailed explanation will be omitted.

Figure 2A:
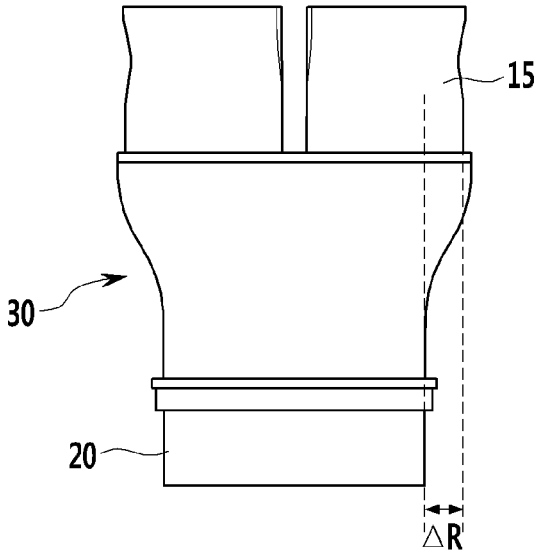
FIGS. 2(A) and 2(B) are drawings for comparing structures and shapes of collectors according to a prior art and the present disclosure, respectively.
Figure 2B:
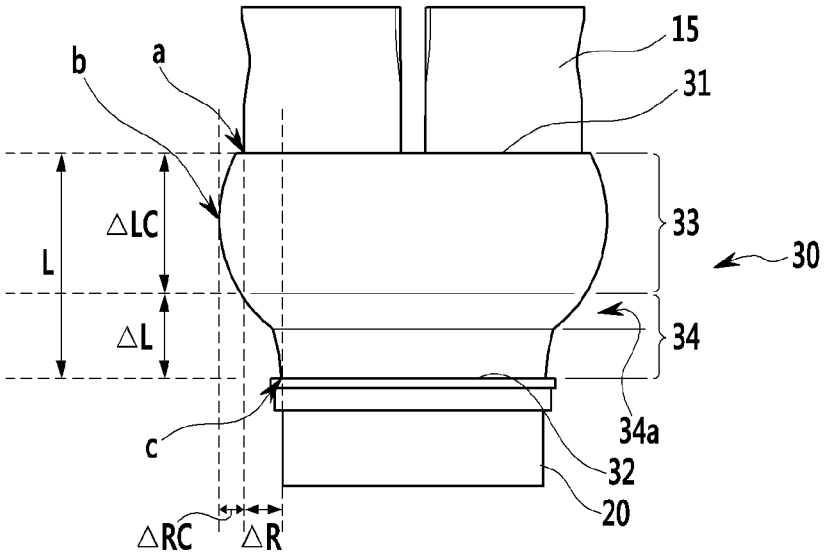

FIGS. 2(A) and 2(B) show structures and shapes of collectors according to the prior art and the present invention.

FIG. 2(A) illustrates a prior collector having a shape in which a radius of a prior collector simply decreases from one end thereof towards another end thereof.

Referring to FIG. 2(B), the collector 30 may comprise at least one inlet 31 fluidly communicating with an exit of the at least one runner 15. An outlet 32 fluidly communicates with the front pipe 20 such that the outlet 32 discharges exhaust gas flowing into the front pipe 20 through the at least one inlet 31. An extended portion 33 has a radius greater than or equal to that of the exit of the at least one runner 15 in a radial direction of the collector 30.

The number of the at least one inlet 31 may be same as the number of the at least one runner 15 or may be only one even when the at least one runner 15 is more than one in which all of the plurality of runners 15 are joined to the only one inlet 31.

In the exhaust manifold 10 according to the present disclosure, two runners 15 are shown in FIG. 2(B) among four runners 15, in which the four runners 15 are joined to one inlet 31.

The radius of the extended portion 33 increases up to ARC from an outermost end 'a' of the exit of the at least one runner 15 at which the at least one runner 15 meets the at least one inlet 31.

The collector has a maximum radius at the point 'b' as shown in FIG. 2(B).

The maximum radius point 'b' may correspond to a middle point of the extended portion 33.

The maximum radius point 'b' corresponds to the middle point of the extended portion 33, and thereby, the extended portion 33 from the end point 'a' to the point 'b' has a diffuser shape.

Due to this diffuser shape of the extended portion 33, a jet velocity increase that is generated in the collector 30 into which flow noise is collected by high-speed exhaust gas can be suppressed.

Further, a vortex phenomenon considerably decreases, such that the volume acoustic power (VAP) decreases by about 12 dB.

Additionally, noise inside a vehicle decreases by about 5 dB in driving in a gradual acceleration condition.

The collector 30 may further comprise a nozzle portion 34 formed such that a radius of one end of the nozzle portion 34 towards the at least one inlet 31 is greater than that of the opposite end of the nozzle portion 34 towards the outlet 32 as shown in FIG. 2(B).

The nozzle portion 34 is formed such that an external circumference surface of the collector 30 is gradually and continuously connected to an external circumference surface of the front pipe 20. Further, the nozzle portion 34 may include a diminishing portion 34*a* having a diminishing radius in a direction from the one end of the nozzle portion 34 towards the other end thereof. A remaining portion of the nozzle portion 34 excluding the diminishing portion 34*a* may have the same radius.

Referring to FIG. 2(B), an exit of the extended portion 33 and an entry of the nozzle portion 34 are connected. A distance ARC of the collector 30 between the outermost end point 'a' and the maximum radius point 'b' is less than or equal to half of a distance ΔR of the collector 30 between the outermost end point 'a' of and an outermost end point 'c' of the front pipe 20 in a radial direction thereof.

This is because decrease effect of VAP starts to become smaller when ΔRC/ΔR is more than 0.5, so a benefit to increase curvature of an external circumference surface of the extended portion 33 disappears.

An entry of the extended portion 33 may be connected to the at least one inlet 31, and an exit of the extended portion 33 may be connected to the nozzle portion 34.

An exit of the nozzle portion 34 may be connected to the outlet 32. Here, the nozzle portion 34 cannot be positioned at an upper portion of the extended portion 33.

Length ΔLC of the extended portion 33 may be greater than or equal to 0.5 times length L of the collector for coupling the extended portion 33 having the diffuser shape and the nozzle portion 34.

A side profile of the extended portion 33 may have a convex or parabolic shape as shown in FIG. 2(B).

Figure 3:
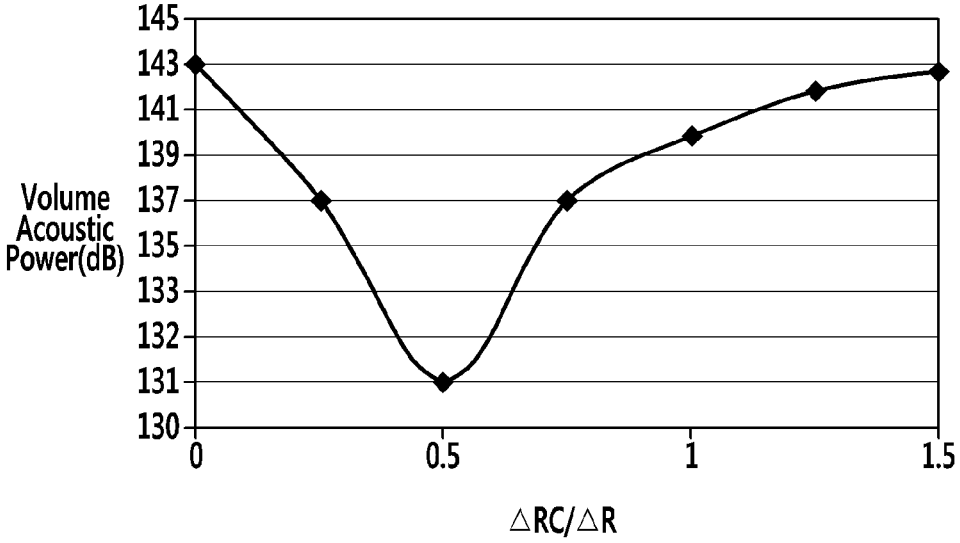
FIG. 3 is a graph illustrating a dampening effect of exhaust noise using a collector according to the present disclosure.

FIG. 3 is a graph illustrating a dampening effect of exhaust noise using a collector according to the present disclosure. Here, VAP (dB) is decreased according to values of ΔRC/ΔR.

As in the above description, the low noise of an exhaust system is dampened in a gradual acceleration condition by a shape and a structure of the collector according to the present disclosure, thereby improving marketability of a vehicle.

While this disclosure has been described in connection with what is presently considered to be a practical exemplary embodiment, it is to be understood that the invention is not limited to the disclosed embodiment, but on the contrary, is intended to cover various modifications and equivalent arrangements included within the spirit and scope of the appended claims.

What is claimed is:

1. An exhaust system structure comprising:

an exhaust manifold discharging exhaust gas through at least one runner towards an exhaust pipe;

a front pipe for exhausting the exhaust gas received from the exhaust manifold to a front end of the exhaust pipe; and a collector having an upstream end forming at least one inlet connected with the at least one runner and a downstream end forming an outlet connected with the front pipe, such that the exhaust gas flows from the upstream end to the front pipe through the collector, wherein the collector comprises:

an extended portion starting from the upstream end of the collector and having a larger radius than a radius of the upstream end of the collector; and a nozzle portion having a smaller radius than the radius of the upstream end, the nozzle portion starting from a downstream end of the extended portion and ending at the downstream end of the collector.

2. The exhaust system structure of claim 1,
wherein a radius of the nozzle portion monotonically decreases along an upstream to downstream direction.

3. The exhaust system structure of claim 2,
wherein the nozzle portion comprises:
a convex portion that is convex in a radial direction of the collector, the convex portion starting from the downstream end of the extended portion; and
a non-convex portion that is not convex in the radial direction of the collector, the non-convex portion starting from a downstream end of the convex portion and ending at the downstream end of the collector.

4. The exhaust system structure of claim 1,
wherein
a difference between a largest radius of the extended portion and the radius of the upstream end of the collector is 0.5 times of a difference between the radii of the upstream end and the downstream end of the collector.

5. The exhaust system structure of claim 1,
wherein an entry of the extended portion is connected to the at least one inlet.

6. The exhaust system structure of claim 1,
wherein the extended portion has a length greater than or equal to half of that of the collector.

7. The exhaust system structure of claim 1,
wherein a side profile of the extended portion has a convex or parabolic shape along a length direction of the extended portion.

8. The exhaust system structure of claim 1, wherein the number of the at least one inlet is same as the number of the at least one runner.

9. The exhaust system structure of claim 1, further comprising:
a bellows having a cylindrical shape and connected to the front pipe.

10. The exhaust system structure of claim 4, wherein the maximum radius point is a middle point of the extended portion.

11. The exhaust system structure of claim 1, wherein the extended portion is convex in a radial direction of the collector.

* * * * *